United States Patent [19]

Watanabe

[11] Patent Number: 4,764,134

[45] Date of Patent: Aug. 16, 1988

[54] TRIMMING DEVICE FOR MARINE PROPULSION UNIT

[75] Inventor: Eifu Watanabe, Hamamatsu, Japan

[73] Assignee: Sanshin Kogyo Kabushiki Kaisha, Hamamatsu, Japan

[21] Appl. No.: 945,663

[22] Filed: Dec. 23, 1986

[30] Foreign Application Priority Data

Dec. 27, 1985 [JP] Japan ..... 60-294872

[51] Int. Cl.[4] ..... B63H 21/26

[52] U.S. Cl. ..... 440/53; 440/61

[58] Field of Search ..... 248/642, 643; 440/53, 440/55, 56, 58–63

[56] References Cited

U.S. PATENT DOCUMENTS 2,927,552 3/1960 Mickey ..... 440/61
3,008,445 11/1961 Frank ..... 440/61
3,053,489 11/1962 Robinson et al. ..... 440/61
3,581,702 6/1971 Moberg ..... 440/61
4,720,278 1/1988 Taguchi et al. ..... 440/61

*Primary Examiner*—Sherman D. Basinger
*Attorney, Agent, or Firm*—Ernest A. Beutler

[57] ABSTRACT

An improved thrust taking arrangement for an outboard drive wherein anti-friction members are provided for transferring the thrust between the trim adjusting thrust member and the outboard drive. The anti-friction members comprise rollers carried in a downwardly facing opening of the outboard drive. In some embodiments, the rollers are balls and in other embodiments they are cylindrical elements that rotate about an axis parallel to the trim pivot axis of the outboard drive. In some embodiments, the roller members contact a concavely curved surface of the thrust member and the radii of curvature are different so as to minimize relative movement.

22 Claims, 3 Drawing Sheets

TRIMMING DEVICE FOR MARINE PROPULSION UNIT

BACKGROUND OF THE INVENTION

This invention relates to a trimming device for a marine propulsion unit and more particularly to an improved connection between the trim unit and the outboard drive.

In a wide variety of outboard drives, both outboard motors and the outboard drive section of an inboard/-outboard drive, there is an arrangement incorporated for adjusting the trim position of the pivotally supported outboard drive. In one form of powered trim adjustment, a trim cylinder is carried by the transom of the watercraft and has an actuating rod or thrust member that engages the outboard drive and which urges it about its pivotal axis to change the trim position. In addition, the thrust member of the trim unit takes the driving thrust from the outboard drive during forward propulsion. Normally, the thrust member reciprocates along a fixed axis whereas the outboard drive pivots about a fixed axis. As a result of this, there will be relative movement between the thrust member and the outboard drive that can result in wear, galling and other unsatisfactory conditions. In addition, such relative movement causes noise during operation.

Some of the disadvantageous conditions can be reduced through the position of a roller member (either a ball or a rolling cylindrical member) on the end of the trim thrust member. However, these trim thrust members are normally disposed at an upwardly and rearwardly inclined axis so that water may very well accumulate within them and accumulate under the thrust roller. As a result, corrosion can set in and the advantages will be lost.

One way to avoid corrosion would be to incorporate a grease fitting and grease packing under the roller member. However, this requires servicing. In addition, the grease may be depleted and if not promptly replaced, the same corrosion problems as aforenoted can result.

It is, therefore, a principal object of this invention to provide an improved trim arrangement for an outboard drive.

It is a further object of this invention to provide a trim arrangement for an outboard drive embodying an improved anti-friction arrangement wherein the likelihood of damage through corrosion is substantially reduced.

It is a further object of this invention to provide an arrangement wherein the thrust is transferred between the thrust taking member and the outboard drive through a roller that is carried by the outboard drive.

In connection with tilt and trim units of the type as aforedescribed, one of the principal problems that results from the relative movement is the abrasion, wear and noise as aforenoted.

It is, therefore, a still further object of this invention to provide a thrust transfer arrangement between a trim thrust member and an outboard drive wherein relative movement is reduced.

SUMMARY OF THE INVENTION

This invention is adapted to be embodied in a trim arrangement for a marine outboard drive that includes an outboard drive member that is mounted for pivotal movement through a plurality of trim adjusted positions relative to a transom of an associated watercraft. A trim motor is fixed relative to the transom and has a reciprocating thrust member that is adapted to bear against the outboard drive member for effecting pivotal movement of the outboard drive member relative to the transom upon reciprocation of the thrust member.

In accordance with a first feature of the invention, an anti-friction means is interposed between the thrust member and the outboard drive member for reducing friction upon reciprocation of the thrust member. This anti-friction means comprises roller means that are carried by the outboard drive for transmitting forces between the outboard drive and the thrust member.

Yet another feature of the invention is adapted to be embodied in a trim arrangement of the type as aforedescribed. In accordance with ths feature of the invention, anti-friction means are interposed between the thrust member and the outboard drive member for reducing friction upon reciprocation of the thrust member. With the feature of the invention, the anti-friction means comprises a first convexly curved element carried by one of the members and a cooperating concavely curved element carried by the other of the members. The convex and concave curved elements are in engagement and form the means for transmitting the thrust between the members.

In accordance with yet another feature of the invention, the anti-friction means that is interposed between the thrust member and the outboard drive member for reducing friction upon reciprocation of the thrust member comprises a movable surface that is engaged with the thrust member and which is supported by anti-friction bearings on the outboard drive member for movement relative to the outboard drive member upon its trim movement.

DETAILED DESCRIPTION OF THE PREFERRED EMBODIMENTS

Figure 1:
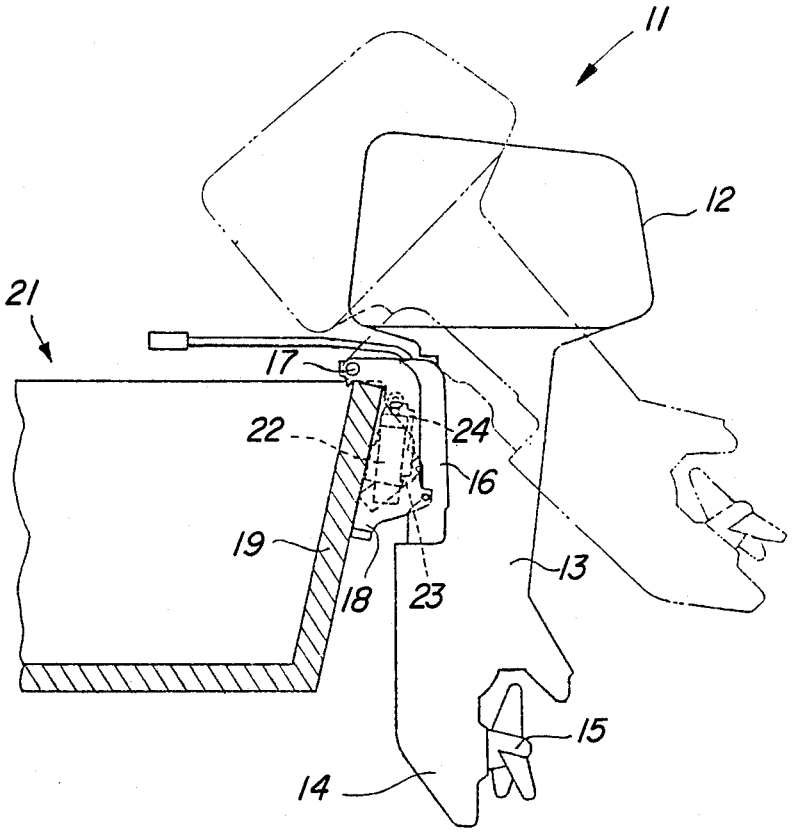
FIG. 1 is a partial side elevational view of an outboard motor attached to the transom of a watercraft (shown partially and in section) and showing a first embodiment of the invention.

Referring first to FIG. 1, the general environment in which the invention may be practiced is illustrated. An outboard motor, indicated generally by the reference numeral 11, comprises the outboard drive in this embodiment. The term "outboard drive" is utilized to describe either an outboard motor or the outboard drive portion of an inboard/outboard drive.

The outboard motor 11 includes a power head 12 from which a drive shaft housing 13 depends. A lower unit 14 is provided at the lower end of the drive shaft housing 13 and contains a propeller 15 that is driven in a known manner.

A steering shaft (not shown) is fixed in a known manner to the drive shaft housing 13 and is journaled for steering movement about a generally vertically extending axis within a swivel bracket 16. The swivel bracket 16 is, in turn, pivotally connected by means of a pivot pin 17 to a clamping bracket 18. The pivot pin 17 permits tilting movement of the outboard drive 11 about the horizontally disposed axis defined by the pivot pin 17 for either trim adjustment or for pivotal movement of the outboard drive 11 to a tilted up out of the water condition as shown in phantom in FIG. 1. The clamping bracket 18 is affixed to a transom 19 of a watercraft 21 in a known manner.

Tilting movement of the outboard drive 11 is controlled primarily by means of a tilt cylinder assembly 22 while the trim condition of the outboard drive 11 is controlled primarily by a trim cylinder assembly 23. The tilt cylinder assembly 22 and trim cylinder assembly 23 are both powered by means of fluid delivered by a fluid pump that is driven by a reversible electric motor 24 in a known manner. The structure of the outboard drive 11 and its tilt and trim arrangement as thus far described may be considered to be conventional.

Figure 2:
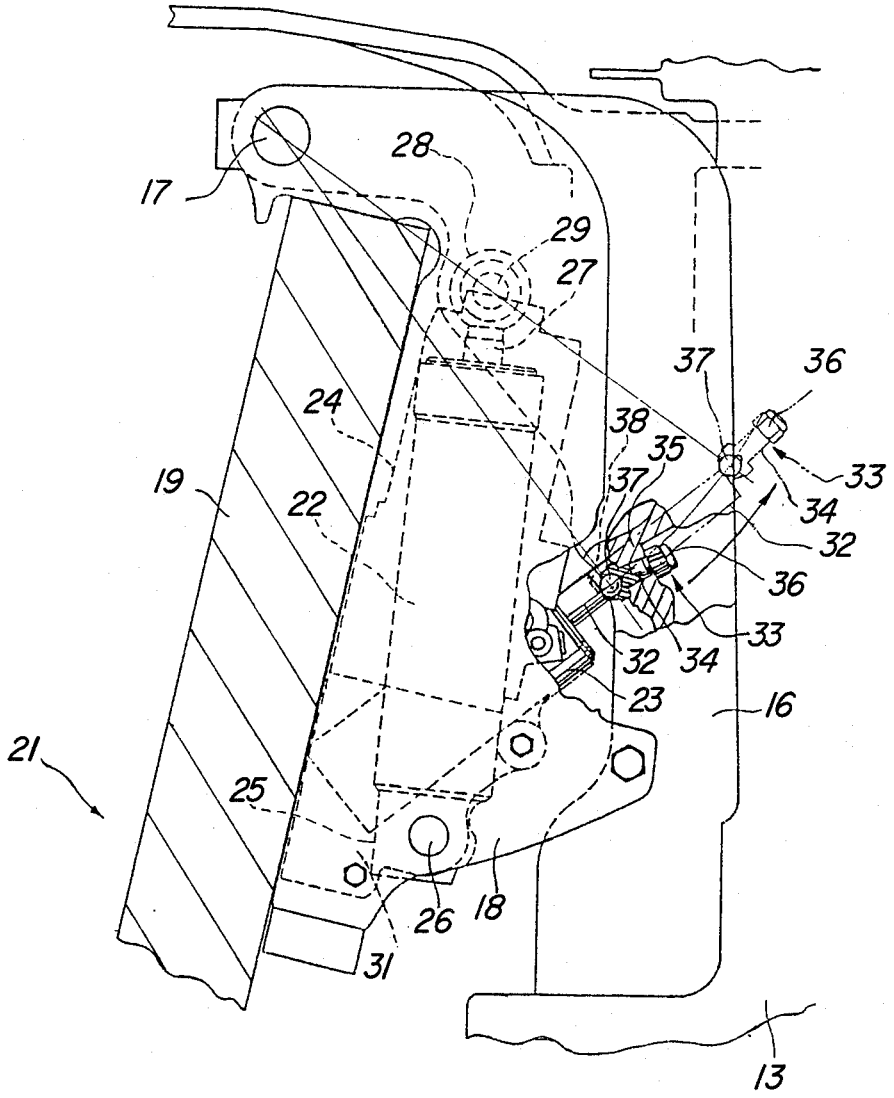
FIG. 2 is an enlarged side elevational view, with a portion broken away, showing the tilt and trim adjusting mechanism.

Referring now in detail to FIG. 2, the tilt cylinder assembly 22 includes a cylinder housing that is formed with a trunnion 25 that is pivotally connected to the clamping bracket 18 by means of a pivot pin 26. The cylinder housing is divided into a pair of fluid chambers by a piston (not shown) to which a piston rod 27 is affixed. The piston rod 27 extends through the upper end of the cylinder housing and has affixed to it an eyelet 28 that is pivotally connected to the swivel bracket 16 by means of a pivot pin 29. It should be readily apparent, therefore, that extension and retraction of the piston rod 27 will effect pivotal movement of the swivel bracket 16 relative to the clamping bracket 18 for pivoting the outboard drive 11 about the pivot pin 17. The tilt cylinder assembly is a high speed, low force fluid motor and is normally employed for pivoting the outboard drive 11 from a trim up condition to a tilted up out of the water condition, which as has been noted is shown in phantom in FIG. 1.

The trim cylinder assembly 23 is affixed to a bracket 31 that is carried by the clamping bracket 18. Like the tilt cylinder 22, the trim cylinder 23 includes a cylinder housing that is divided into an upper and lower section by a piston (not shown). The cylinder housing of the trim cylinder 23 is, however, rigidly affixed to the bracket 31. A piston rod 32 is rigidly affixed to the piston of the trim cylinder assembly 23 and normally bears directly against the swivel bracket 16 for effecting its pivotal movement. Because the trim piston rod 32 reciprocates along a fixed axis while the swivel bracket 16 pivots about a spaced axis defined by the pivot pin 17, there occurs relative movement which can cause wear, galling and noise. In accordance with this invention, an anti-friction thrust arrangement, indicated generally by the reference numeral 33, is provided for transferring thrust forces between the piston rod 32 and the swivel bracket 16.

The thrust taking arrangement 33 includes a carrier member 34 which is, in the illustrated embodiments, a shaft that is received within an appropriate opening formed in a thrust receiving portion 35 of the swivel bracket 16. A nut 36 cooperates with a threaded portion of the carrier member 34 for holding it in position.

It should be noted that the carrier member 34 is disposed so that it is inclined downwardly and forwardly even in the lowermost trim down adjusted position as shown in the solid line view of FIG. 2. At the lower end of the carrier member 34, it is provided with a recess in which an anti-friction roller in the form of a ball bearing member 37 is captured. The ball bearing member 37 is engaged within a conical shape recess 38 formed at the outer end of the piston rod 32. The radius of curvature of the recess 38 is substantially greater than the radius of curvature of the ball 37 so as to minimize the relative movement therebetween while the piston rod 32 extends so as to effect pivotal movement of the outboard drive between its trim down position as shown in the solid line view of FIG. 1, and its fully trimmed up position as shown in the phantom line view of this figure.

It should be noted that the thrust taking arrangement 33 also transfers the forward driving thrust from the swivel bracket 16 to the clamping bracket 18 for powering the outboard motor in a forward direction. Hence, it is important that the thrust taking arrangement 33 be such that it can absorb high forces and also that it will last a long time. Because of the downward opening of the cavity in which the ball 37 is received, water is not as likely to accumulate at the base of this cavity. Also, the ball member 37 may be easily replaced through removal of the nut 36 and the carrier member 34 and replacement of the carrier member 34 and ball 37 with new elements.

In the described embodiment, the trim cylinder 23 and tilt cylinder 22 have been described as hydraulic cylinders. It is to be understood, however, that the invention can be equally as well utilized in conjunction with arrangements wherein either one or both of these cylinders are mechanical elements for effecting reciprocating movement of the rods 27 and 32, such as screw jacks or the like.

Figure 3:
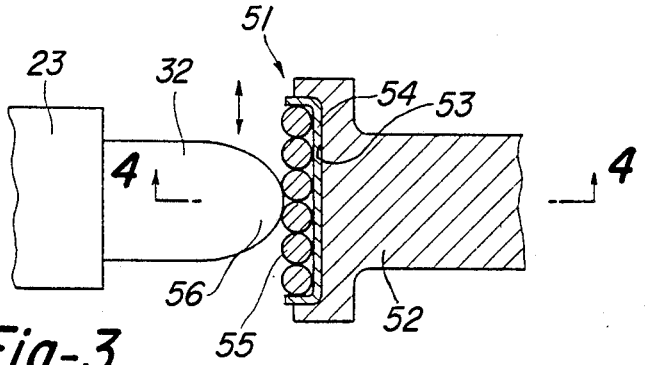
FIG. 3 is a partial, enlarged view showing the thrust taking arrangement of the trim mechanism of another embodiment of the invention.
Figure 4:
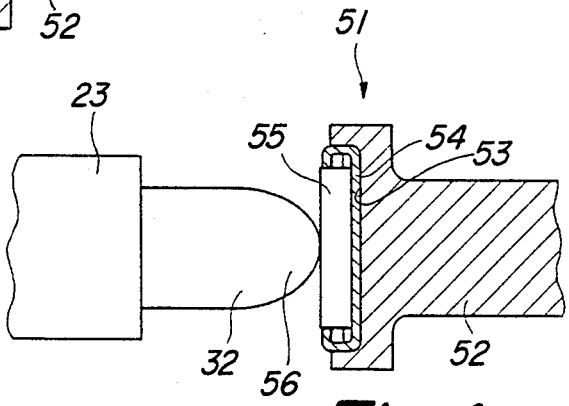
FIG. 4 is a cross-sectional view taken along the line 4—4 of FIG. 3.

In the embodiment of FIGS. 1 and 2, the anti-friction thrust taking member 34 was comprised of a ball 37 that cooperated with a concave surface 38 of the piston rod. However, other forms of anti-friction thrust taking members may be employed and such an alternative construction is shown in FIGS. 3 and 4 and is identified generally by the reference numeral 51. In this embodiment, the anti-friction thrust taking connection 51 includes a carrier member 52 that is affixed to the swivel bracket 16 in a manner similar to that of the embodiment of FIGS. 1 and 2. For that reason, this connection has not been illustrated. In this embodiment, a cavity 53 is formed in the lower end of the carrier member 52 and receives a cage 54 of a roller bearing assembly 55. The roller bearings 55 are disposed to rotate about axes that are parallel to the axis of the pivot pin 17 for the tilting movement of the swivel bracket 16.

The piston rod 32 of the trim cylinder 23 is provided with an arcuate surface 56 that directly engages the roller bearings 55 for transferring the thrust between the trim cylinder 23 and specifically its thrust delivering member 32 (the piston rod) and the swivel bracket 16. It should be readily apparent that this embodiment has many of the same advantages as the embodiment of FIG. 2 in that the cavity 53 is downwardly facing and hence moisture will not accumulate within it. In addition, the roller bearings 55 will provide long life, reduce noise and also reduce wear.

Figure 5:
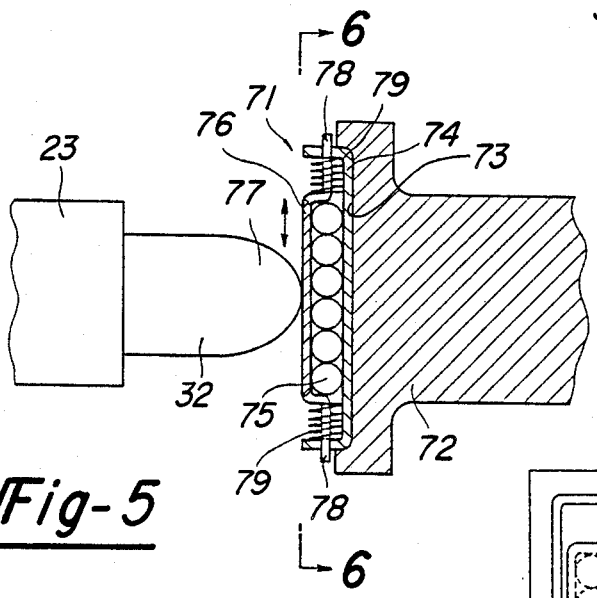
FIG. 5 is a partial side elevational view of the thrust taking arrangement of still another embodiment of the invention.
Figure 6:
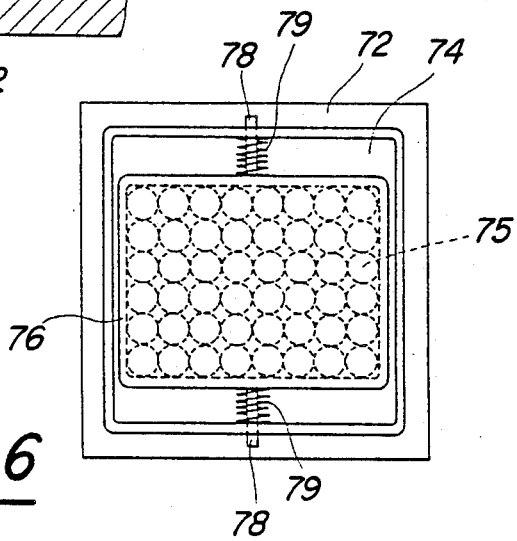
FIG. 6 is a cross-sectional view taken along the line 6—6 of FIG. 5.

Still another embodiment of the invention is shown in FIGS. 5 and 6 wherein the anti-friction thrust taking arrangement of this embodiment is identified generally by the reference numeral 71. In this embodiment, a carrier member 72 is affixed to the swivel bracket 16 in the same manner as in the previously described embodiment. The carrier member 72 is formed with a downwardly facing opening 73 in which a cage 74 of a ball bearing assembly comprised of a plurality of ball bearings 75 is provided. The ball bearings 75 are trapped between the cage 74 and an outer cage or thrust plate 76 that is engaged directly by an arcuate end 77 of the piston rod 32.

The outer member 76 is provided with a pair of pin projections 78 that are received wthin complementary shaped openings formed in the inner cage 74 so as to fix the cages 74 and 76 together but to pemit the cage 76 to move relative to the cage 74 in a vertical direction. A pair of coil compression springs 79 encircle the pins 78 and act between the cages 76 and 74 so as to resist this relative movement.

When the piston rod 32 extends or contracts, the frictional forces between its curved end portion 77 and the inner cage 76 will cause the two elements to tend to move together in the same vertical direction. The ball bearings 75 permit this movement with minimum friction and resistance while the springs 79 tend to maintain the elements in a centralized position. Hence, there will be even less wear with this embodiment than with the previously described embodiments while it retains all of the advantages as previously described.

It should be readily apparent from the foregoing description that a number of embodiments of the invention have been illustrated and described, each of which provides a highly effective arrangement for reducing wear and galling between the trim thrust member and the outboard drive while at the same time minimizing the likelihood of corrosion adversely affecting this connection and reducing servicing requirements. Although a number of embodiments of the invention have been illustrated and described, various changes and modifications may be made without departing from the spirit and scope of the invention, as defined by the appended claims.

I claim:

1. In a trim arrangement for a marine outboard drive member mounted for pivotal movement through a plurality of trim adjusted positions relative to a transom of an associated watercraft, a trim motor fixed relative to the transom and having a reciprocating thrust member adapted to bear against said outboard drive member for effecting pivotal movement of said outboard drive member relative to the transom upon reciprocation of said thrust member, the improvement comprising anti-friction means interposed between said thrust member and said outboard drive member for reducing friction upon reciprocation of said thrust member, said anti-friction means comprising roller means carried by said outboard drive member for transmitting forces between said outboard drive member and said thrust member, said roller means being rotatably journaled relative to said outboard drive member.

2. In a trim arrangement as set forth in claim 1 wherein the roller means are carried in a downwardly opening socket formed in the outboard drive member.

3. In a trim arrangement as set forth in claim 1 wherein the roller means comprises at least one ball bearing.

4. In a trim arrangement as set forth in claim 3 wherein the ball bearing is supported within a downwardly opening socket formed in the outboard drive member.

5. In a trim arrangement as set forth in claim 3 wherein the thrust member has a concave bearing surface in which the ball bearing is received, the ball bearing and the concave bearing surface having different radii of curvature.

6. In a trim arrangement as set forth in claim 5 wherein the ball bearing is supported within a downwardly opening socket formed in the outboard drive member.

7. In a trim arrangement as set forth in claim 1 wherein the roller means comprises a cylindrical member rotatable about an axis parallel to the tilt axis of the outboard drive member.

8. In a trim arrangement as set forth in claim 7 wherein there are a plurality of cylindrical members supported about parallel axes.

9. In a trim arrangement as set forth in claim 8 wherein the cylindrical members are supported within a downwardly opening socket in the outboard drive member.

10. In a trim arrangement as set forth in claim 8 further including a thrust member movably supported by the outboard drive member and interposed between the cylindrical members and the trim motor thrust member.

11. In a trim arrangement as set forth in claim 10 wherein the thrust member is spring biased to a neutral position.

12. In a trim arrangement as set forth in claim 11 wherein the thrust member and the cylindrical members are supported within a downwardly opening socket formed in the outboard drive member.

13. In a trim arrangement as set forth in claim 8 wherein the trim motor thrust member directly engages the cylindrical members.

14. In a trim arrangement as set forth in claim 13 wherein the trim motor thrust member has a curved thrust surface.

15. In a trim arrangement as set forth in claim 14 wherein the cylindrical members are supported within a downwardly opening socket in the outboard drive member.

16. In a trim arrangement for a marine outboard drive member mounted for pivotal movement through a plurality of trim adjusted positions relative to a transom of an associated watercraft, a trim motor fixed relative to the transom and having a reciprocating thrust member adapted to bear against said outboard drive member for effecting pivotal movement of said outboard drive member relative to the transom upon reciprocation of said thrust member, the improvement comprising anti-friction means interposed between said thrust member and said outboard drive member for reducing friction upon reciprocation of said thrust member, said anti-friction means comprising a convexly curved element carried by said outboard drive member and a concavely curved element carried by said thrust member, said convex and said concave elements being in engagement with each other for transmitting forces between said members.

17. In a trim arrangement as set forth in claim 16 wherein the radii of curvature of the curved elements are different from each other.

18. In a trim arrangement as set forth in claim 16 wherein the convexly curved element is carried in a downwardly facing opening of the outboard drive member.

19. In a trim arrangement as set forth in claim 18 wherein the radii of curvature of the curved elements are different from each other.

20. In a trim arrangement for a marine outboard drive member mounted for pivotal movement through a plurality of trim adjusted positions relative to a transom of an associated watercraft, a trim motor fixed relative to the transom and having a reciprocating thrust member adapted to bear against said outboard drive member for effecting pivotal movement of said outboard drive member relative to the transom upon reciprocation of said thrust member, the improvement comprising anti-friction means interposed between said thrust member and said outboard drive member for reducing friction upon reciprocation of said thrust member, said anti-friction means comprising a thrust plate carried by said outboard drive member and engaged with said thrust member for transmitting forces therebetween, anti-friction means for mounting said thrust plate for movement relative to said outboard drive member upon relative movement of said outboard drive member to the transom about the pivot axis.

21. In a trim arrangement as set forth in claim 20 wherein the anti-friction means comprises a plurality of roller members interposed between the thrust plate and the outboard drive member.

22. In a trim arrangement as set forth in claim 20 further including biasing means for resisting movement of the thrust plate relative to the outboard drive member.

* * * * *